US009396901B2

(12) United States Patent
Lee et al.

(10) Patent No.: US 9,396,901 B2
(45) Date of Patent: Jul. 19, 2016

(54) FIELD EMISSION DEVICES AND METHODS OF MANUFACTURING EMITTERS THEREOF

(71) Applicant: Samsung Electronics Co., Ltd., Suwon-Si, Gyeonggi-Do (KR)

(72) Inventors: Donggu Lee, Gumi-si (KR); Shanghyeun Park, Yongin-si (KR); Yongchul Kim, Seoul (KR); Ilhwan Kim, Seoul (KR); Taewon Jeong, Yongin-si (KR)

(73) Assignees: Samsung Electronics Co., Ltd., Gyeonggi-do (KR); Kumoh National Institute of Technology Industry-Academic Cooperation Foundation, Gyeongsangbukodo (KR)

( * ) Notice: Subject to any disclaimer, the term of this patent is extended or adjusted under 35 U.S.C. 154(b) by 0 days.

(21) Appl. No.: 14/474,213

(22) Filed: Sep. 1, 2014

(65) Prior Publication Data

US 2015/0060758 A1 Mar. 5, 2015

(30) Foreign Application Priority Data

Sep. 2, 2013 (KR) ..... 10-2013-0105099

(51) Int. Cl.
*H01J 1/308* (2006.01)
*H01J 9/02* (2006.01)
*H01J 1/304* (2006.01)

(52) U.S. Cl.
CPC ..... *H01J 9/025* (2013.01); *H01J 1/3046* (2013.01); *H01J 2201/30423* (2013.01); *H01J 2201/30461* (2013.01)

(58) Field of Classification Search
CPC ..... H01J 1/308; H01J 1/3044; H01J 9/025; H01J 2201/30415; H01J 2201/30453; H01J 1/3046; H01J 2201/30423; H01J 2201/30461
See application file for complete search history.

(56) References Cited

U.S. PATENT DOCUMENTS 6,097,138 A * 8/2000 Nakamoto ..... H01J 1/3042 313/309
7,893,605 B2 2/2011 Mammana et al.
(Continued)

FOREIGN PATENT DOCUMENTS

CN 102339699 A * 2/2012
KR 100441751 B1 7/2004
(Continued)

OTHER PUBLICATIONS

Zhong-Shuai Wu et al., Advanced Materials, 2009, 21, pp. 1756-1760. File name FieldEmissionSingleLayerGraphene.pdf.*
(Continued)

*Primary Examiner* — Joshua King
*Assistant Examiner* — Mohammed R Alam
(74) *Attorney, Agent, or Firm* — Harness, Dickey & Pierce, P.L.C.

(57) ABSTRACT

A field emission device may comprise: an emitter comprising a cathode electrode and an electron emission source supported by the cathode electrode; an insulating spacer around the emitter, the insulating spacer forming an opening that is a path of electrons emitted from the electron emission source; and/or a gate electrode around the opening. The electron emission source may comprise a plurality of graphene thin films vertically supported in the cathode electrode toward the opening.

5 Claims, 9 Drawing Sheets

(56) References Cited

U.S. PATENT DOCUMENTS

| | | | | |
|---|---|---|---|---|
| 2007/0188067 | A1* | 8/2007 | Tsukamoto | B82Y 10/00 313/309 |
| 2009/0136707 | A1* | 5/2009 | Ueno | C22C 47/14 428/113 |
| 2010/0086777 | A1* | 4/2010 | Kim | B32B 15/08 428/344 |
| 2011/0254432 | A1 | 10/2011 | Zeininger | |
| 2013/0045385 | A1* | 2/2013 | Kim | B22F 1/02 428/403 |

FOREIGN PATENT DOCUMENTS

| | | | |
|---|---|---|---|
| KR | 101017036 | B1 | 2/2011 |
| KR | 101117692 | B1 | 2/2012 |

OTHER PUBLICATIONS

Machine translation of CN102339699 (A). File name CN102339699A.pdf.*

* cited by examiner

FIELD EMISSION DEVICES AND METHODS OF MANUFACTURING EMITTERS THEREOF

CROSS-REFERENCE TO RELATED APPLICATION(S)

This application claims priority from Korean Patent Application No. 10-2013-0105099, filed on Sep. 2, 2013, in the Korean Intellectual Property Office (KIPO), the entire contents of which are incorporated herein by reference.

BACKGROUND

1. Field

Some example embodiments may relate to field emission devices and/or methods of manufacturing emitters of the field emission devices.

2. Description of Related Art

Electron emission is the phenomenon in which electrons in a solid receive from the outside energy equal to or greater than their work function and thus leave the solid. The energy may be provided in various forms, such as heat, light, electric field, and the like. Field emission devices that emit cold electrons from a conductor via a field emission effect, that is, by applying an electric field to the conductor, are used in various fields. For example, a field emission device having a cathode electrode and a gate electrode is used in an X-ray generator, a field emission display, a back light unit, and the like, which employ a triode structure.

In relation to such field emission devices, various studies have been conducted to more efficiently generate a large number of electrons under a relatively low gate voltage.

SUMMARY

Some example embodiments may provide field emission devices for efficiently generating a large number of electrons under a relatively low gate voltage.

Some example embodiments may provide methods of manufacturing emitters of the field emission devices.

In some example embodiments, a field emission device may comprise: an emitter comprising a cathode electrode and an electron emission source supported by the cathode electrode; an insulating spacer around the emitter, the insulating spacer forming an opening that is a path of electrons emitted from the electron emission source; and/or a gate electrode around the opening. The electron emission source may comprise a plurality of graphene thin films vertically supported in the cathode electrode toward the opening.

In some example embodiments, each of the plurality of graphene thin films may comprise: a first portion buried in the cathode electrode; and/or a second portion that extends from the first portion and is exposed from the cathode electrode.

In some example embodiments, the cathode electrode may have a pointed shape toward the opening. The plurality of graphene thin films may be in a pointed structure toward the opening.

In some example embodiments, each of the plurality of graphene thin films may be a graphene single-layered film.

In some example embodiments, each of the plurality of graphene thin films may be a graphene multi-layered film.

In some example embodiments, a field emission device may comprise: a body comprising a cavity and an opening allowing the cavity to communicate with an outside of the body; a cathode electrode in the cavity, wherein a plurality of graphene thin films are vertically toward the opening at a position in the cavity opposite the opening; and/or a gate electrode around the opening.

In some example embodiments, each of the plurality of graphene thin films may comprise: a first portion buried in the cathode electrode; and/or a second portion that extends from the first portion and is exposed from the cathode electrode.

In some example embodiments, each of the plurality of graphene thin films may be a graphene single-layered film or a graphene multi-layered film.

In some example embodiments, a method of manufacturing an emitter may comprise: forming a graphene thin film on a surface of a conductive film; forming a stack structure in which the graphene thin film and the conductive film are repeatedly stacked; forming a sintered structure by molding and sintering the stack structure and a conductive powder, wherein the sintered structure has a form in which the graphene thin film is in a conductor; and/or partially removing the conductor in a length direction of the graphene thin film.

In some example embodiments, the forming of the stack structure may comprise folding the conductive film on which the graphene thin film is formed a number of times.

In some example embodiments, a material of the conductive film may be the same as that of the conductive powder.

In some example embodiments, the method may further comprise: slantingly cutting the sintered structure with respect to the length direction of the graphene thin film to form a spire-shaped structure before performing the partially removing of the conductor.

In some example embodiments, the graphene thin film may be a graphene single-layered film.

In some example embodiments, the graphene thin film may be a graphene multi-layered film.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION

Figure 1:
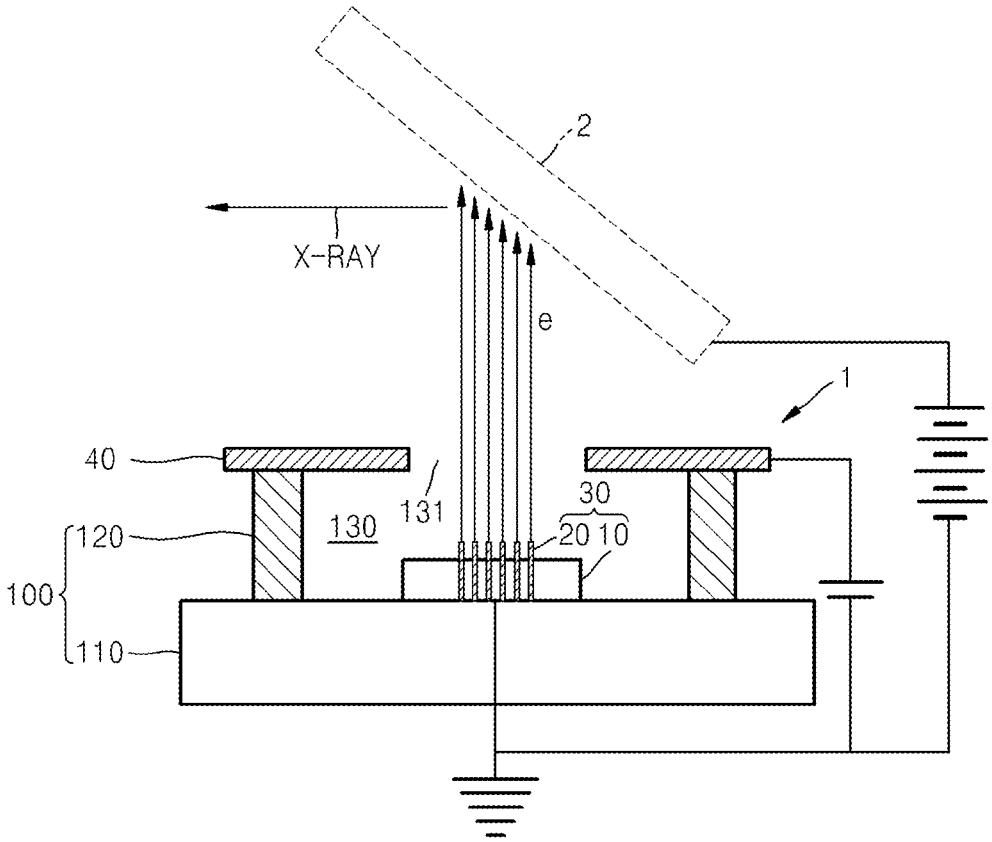
FIG. 1 is a cross-sectional view illustrating a field emission device according to some example embodiments of the inventive concept.

Example embodiments will now be described more fully with reference to the accompanying drawings. Embodiments, however, may be embodied in many different forms and should not be construed as being limited to the embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when an element is referred to as being "on," "connected to," "electrically connected to," or "coupled to" to another component, it may be directly on, connected to, electrically connected to, or coupled to the other component or intervening components may be present. In contrast, when a component is referred to as being "directly on," "directly connected to," "directly electrically connected to," or "directly coupled to" another component, there are no intervening components present. As used herein, the term "and/or" includes any and all combinations of one or more of the associated listed items.

It will be understood that although the terms first, second, third, etc., may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. For example, a first element, component, region, layer, and/or section could be termed a second element, component, region, layer, and/or section without departing from the teachings of example embodiments.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting of example embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Example embodiments may be described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will typically have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature, their shapes are not intended to illustrate the actual shape of a region of a device, and their shapes are not intended to limit the scope of the example embodiments.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Reference will now be made to example embodiments, which are illustrated in the accompanying drawings, wherein like reference numerals may refer to like components throughout.

FIG. 1 is a cross-sectional view illustrating a field emission device 1 according to some example embodiments of the inventive concept.

Referring to FIG. 1, the field emission device 1 includes an emitter 30 and a gate electrode 40. The emitter 30 includes a cathode electrode 10 and an electron emission source 20 supported by the cathode electrode 10. The emitter 30 is disposed on a substrate 110. An insulating spacer 120 is disposed to surround the emitter 30 on the substrate 110. The gate electrode 40 is formed on the insulating spacer 120. A body 100, which has a cavity 130 and an opening 131 allowing the cavity 130 to communicate with the outside, is formed by the substrate 110 and the insulating spacer 120. Electrons generated in the emitter 30 are discharged to the outside through the opening 131. The gate electrode 40 is formed around the opening 131. The gate electrode 40 may be formed along an edge of the opening 131. Also, the gate electrode 40 may extend from an edge of the opening 131 toward an inner side thereof. In this case, the opening 131 is defined by the gate electrode 40.

The emitter 30 is disposed in the cavity 130. The emitter 30 is disposed on the substrate 110 so that the electron emission source 20 is opposite the opening 131. The gate electrode 40 is disposed on the upper surface of the insulating spacer 120, i.e., at an end of the insulating spacer 120 at a side of the opening 131. Thus, the gate electrode 40 surrounds the opening 131 that functions as an electron discharge path. The shape of the opening 131 is not limited thereto, and may be a circle, a tetragon, a pentagon, a hexagon, etc.

Due to the configuration described above, when a voltage is applied to the gate electrode 40, a strong electric field is applied to the electron emission source 20 and thus electrons are emitted from the electron emission source 20 due to an energy that is provided by the electric field. The electrons pass through the opening 131 and move towards an anode electrode 2 illustrated in FIG. 1. By employing the anode electrode 2 formed of a metal, such as molybdenum (Mo), silver (Ag), tungsten (W), chromium (Cr), iron (Fe), cobalt (Co), copper (Cu), or the like, or a metal alloy, an X-ray generator for emitting X-rays may be implemented. In addition, by arranging a plurality of field emission devices in an array form, an X-ray apparatus capable of generating a three dimensional image, e.g., a digital breast tomosynthesis apparatus capable of diagnosing breast cancer may be implemented. Moreover, the field emission device may be used in other various apparatuses, such as a display, a lighting apparatus, and the like.

The density of electrons that are emitted from the electron emission source 20 is proportional to a voltage that is applied to the gate electrode 40. When the aspect ratio of the electron emission source 20 is larger, an electric field strengthening effect increases, and thus, concentration of an electric field concentrated on the electron emission source 20 may be increased, thereby increasing the density of electrons.

Figure 2:
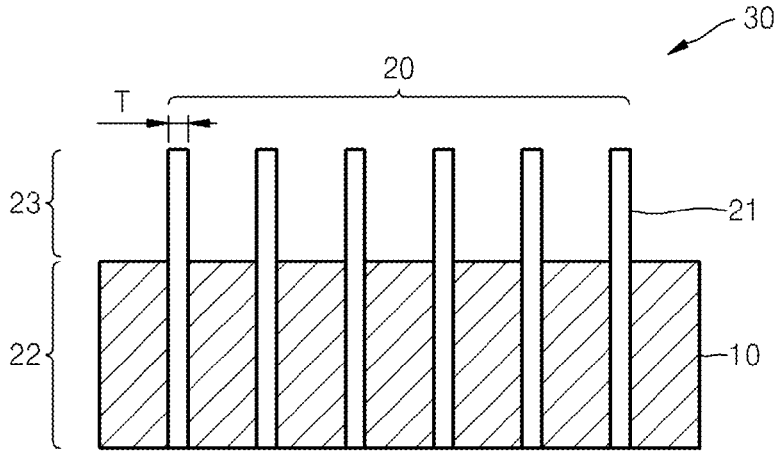
FIG. 2 is a cross-sectional view of an emitter illustrated in FIG. 1, according to some example embodiments of the inventive concept.
Figure 3:
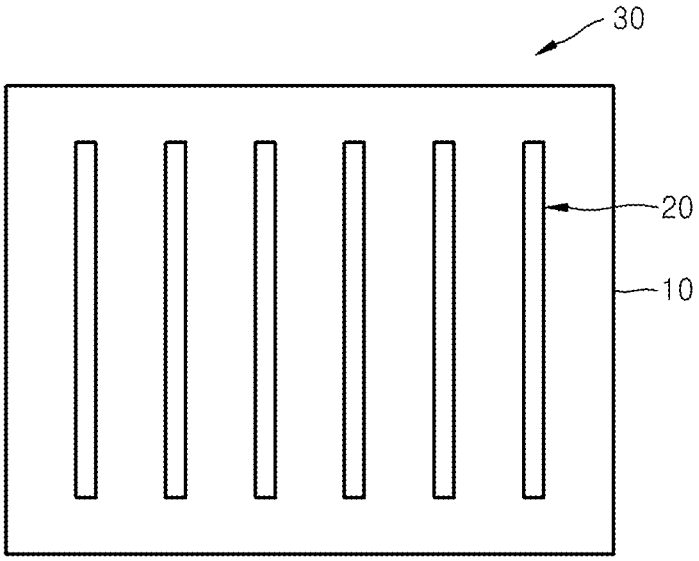
FIG. 3 is a plan view of an emitter illustrated in FIG. 2, according to some example embodiments of the inventive concept.

FIG. 2 is a cross-sectional view of the emitter 30 illustrated in FIG. 1, according to some example embodiments of the inventive concept. FIG. 3 is a plan view of the emitter 30 illustrated in FIG. 2, according to some example embodiments of the inventive concept.

Referring to FIGS. 2 and 3, the emitter 30 includes a cathode electrode 10, which is formed of a conductor, and an electron emission source 20, which includes a plurality of graphene thin films 21 that are vertically supported by the cathode electrode 10 toward the opening 131. Each of the plurality of graphene thin films 21 may be a graphene single-layered film or may be a graphene multi-layered film. The graphene single-layered film and the graphene multi-layered film each have a thickness T from one atom, which is a few angstroms, to several to hundreds of atoms, and thus, a relatively large aspect ratio may be obtained. As a result, a relatively large electric field strengthening effect may be obtained, and thus, a large number of electrons may be easily extracted also under a low gate voltage.

Graphene has a very large electrical conductivity, and thus, a contact resistance thereof to the cathode electrode 10 is very small. Also, graphene has excellent heat conductivity. Thus, excellent electrical and thermal interface characteristics between the graphene thin films 21 and the cathode electrode 10 may be obtained, and the degradation of a field emission efficiency due to electrical and thermal factors may be prevented.

Referring to FIG. 2, each of the graphene thin films 21 has a vertical form, and includes a first portion 22 buried in the cathode electrode 10 and a second portion 23 that extends from the first portion 22 and protrudes from the upper surface of the cathode electrode 10. Due to this configuration, a contact area between the graphene thin films 21 and the cathode electrode 10 may be increased and thus a loss in the field emission efficiency due to the electrical and thermal factors may be further reduced.

Figure 4:
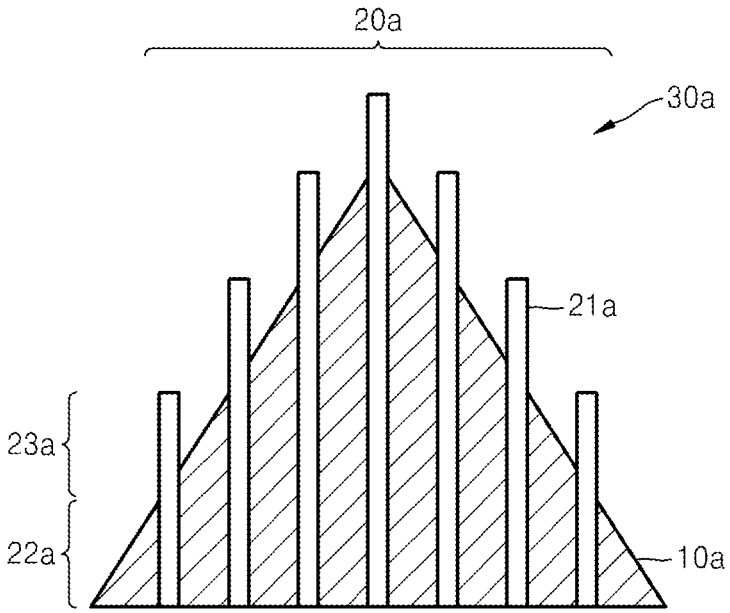
FIG. 4 is a cross-sectional view of an emitter illustrated in FIG. 1, according to some example embodiments of the inventive concept.

FIG. 4 is a cross-sectional view of an emitter 30*a*, which corresponds to the emitter 30 illustrated in FIG. 1, according to some example embodiments of the inventive concept.

Referring to FIG. 4, the emitter 30*a* includes a cathode electrode 10*a*, which is formed of a conductor, and an electron emission source 20*a*, which includes a plurality of vertical graphene thin films 21*a*. Like in the embodiment of FIG. 2, each of the graphene thin films 21*a* has a vertical form, and includes a first portion 22*a* buried in the cathode electrode 10*a* and a second portion 23*a* that extends from the first portion 22*a* and protrudes from the upper surface of the cathode electrode 10*a*. However, the emitter 30*a* illustrated in FIG. 4 has a pointed shape toward the opening 131. That is, the cathode electrode 10*a* has a pointed shape toward the opening 131, and the plurality of graphene thin films 21*a* are arranged on the cathode electrode 10*a* to form a pointed structure toward the opening 131. Due to this structure, the electric field strengthening effect may be maximized, thereby improving the field emission efficiency.

Below, a method of manufacturing the emitter 30 according to some example embodiments of the inventive concept is described with reference to FIGS. 5A through 5G.

[Formation of Graphene Sheet]

Figure 5A:
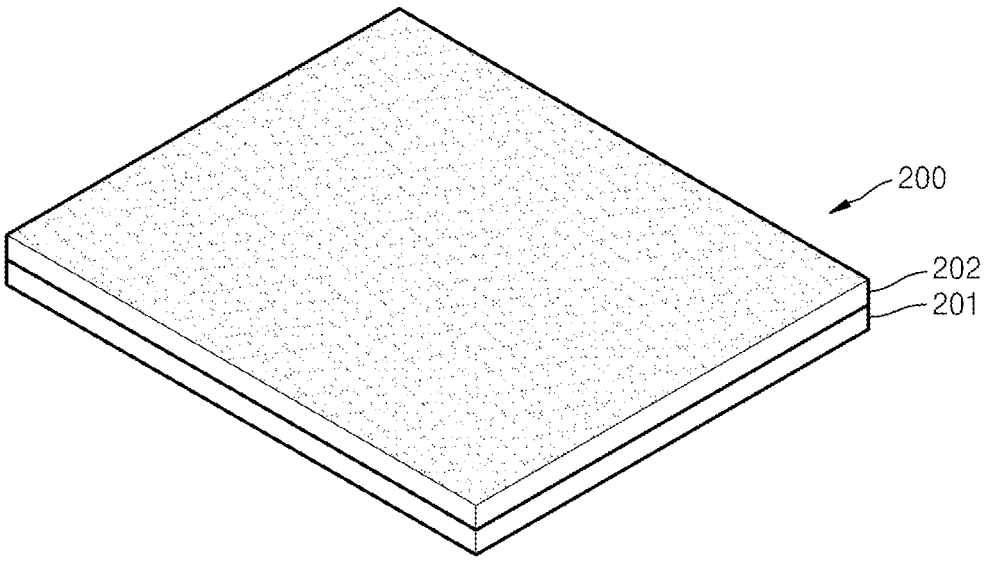
FIG. 5A is a diagram illustrating a graphene sheet including a graphene thin film.

As illustrated in FIG. 5A, a graphene sheet 200 is formed by forming a graphene thin film 202 on a conductive film 201. A method of forming the graphene thin film 202 is not limited to a specific method, and may use any one of various known methods. For example, the graphene thin film 202 may be formed by growing a graphene atom layer on the conductive film 201 through chemical vapor deposition (CVD). When the CVD is used, a large amount of graphene may be formed in a relatively short time. A metal thin film formed of metal may be used as the conductive film 201. Examples of the metal include copper, nickel, cobalt, iron, platinum, gold, aluminum, chromium, magnesium, manganese, molybdenum, rhodium, silicon, tantalum, titanium, tungsten, etc. Hydrogen and hydrocarbon ($C_xH_y$) may be used as the gas (hereinafter, referred to as "growth gas") to grow the graphene atom layer. The hydrocarbon ($C_xH_y$) may include methane, ethane, ethylene, ethanol, acetylene, propane, propylene, butane, butadiene, pentane, pentene, cyclopentadiene, hexane, cyclohexane, benzene, toluene, or the like. The conductive film 201 and the growth gas are supplied into a reactor (not shown) to treat the conductive film 201 by heating. A heat treatment temperature may be, for example, in the range of about 800° C. to about 1000° C., and a heat treatment time may be, for example, in the range of about 30 minutes to about 2 hours.

The number of graphene layers that are grown may be adjusted by various methods. An example of these various methods is a method of controlling the type or thickness of the conductive film 201. For example, when a copper thin film is used as the conductive film 201, the graphene thin film 202 may be formed in the form of a single-layered film. When a transition metal thin film is used as the conductive film 201, the graphene thin film 202 may be formed in the form of a multi-layered film. Another example of the various methods is a method of controlling a heat treatment time and/or a heat treatment speed. Another example of the various methods is a method of controlling the concentration of the growth gas. The number of graphene layers of the graphene thin film 202 may be controlled by any one of the methods stated above or a combination of two or more of the methods stated above.

[Formation of Graphene Stack Structure]

Figure 5B:
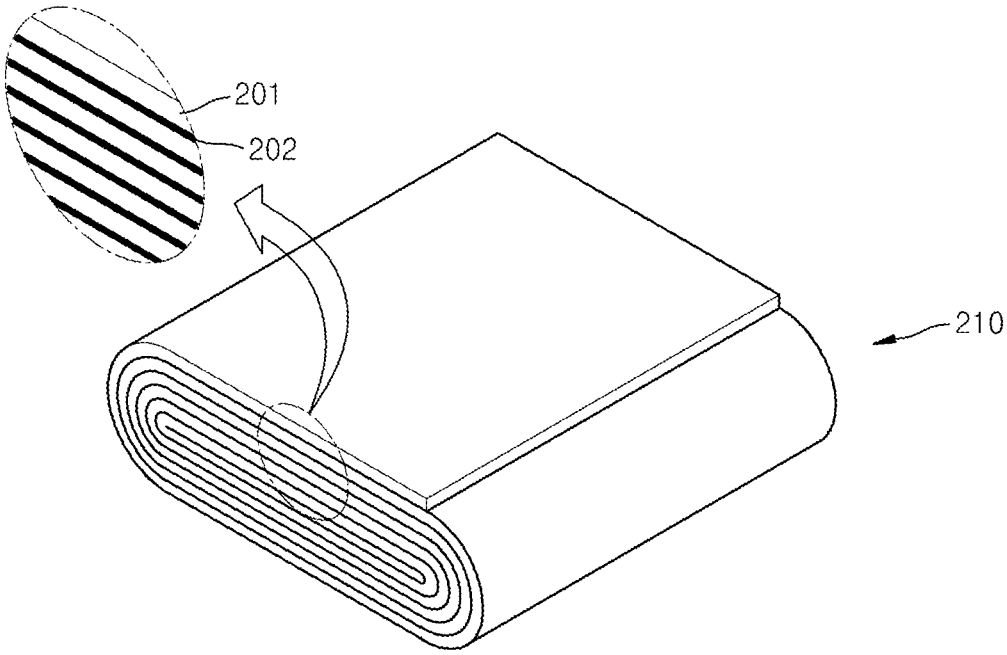
FIG. 5B is a diagram illustrating a graphene stack structure in which a graphene thin film and a conductive film are repeatedly stacked.

As illustrated in FIG. 5B, a graphene stack structure 210 is formed by repeatedly folding the graphene thin film 202 and the conductive film 201. For example, the graphene stack structure 210 may be formed by folding the graphene sheet 200 a number of times. As another example, the graphene stack structure 210 may be formed by stacking a plurality of graphene sheets 200. Then, the graphene stack structure 210 in which a plurality of graphene thin films 202 is stacked with the conductive film 201 interposed therebetween is formed. The number of times that the graphene sheet 200 is folded may be determined in consideration of the number of graphene thin films 21 to be formed in the emitter 30.

[Formation of Sintered Structure]

Figure 5C:
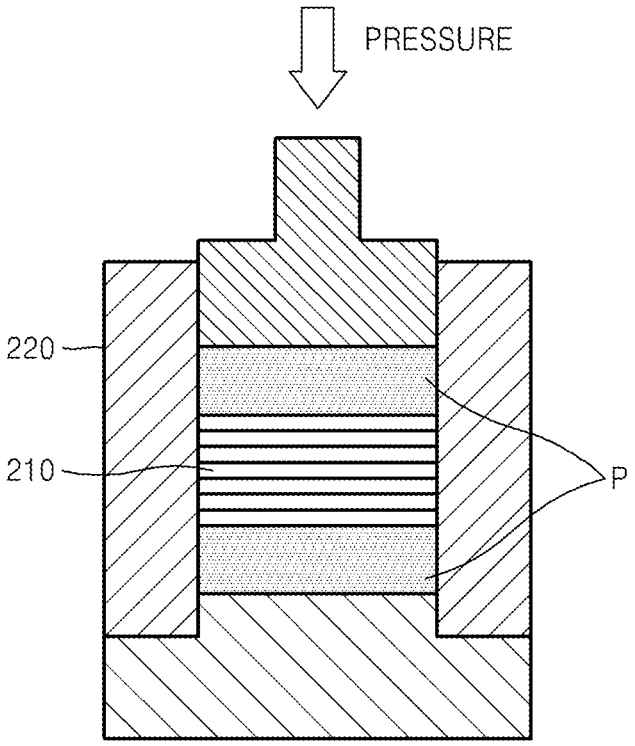
FIG. 5C is a diagram illustrating a process of molding a graphene stack structure and a conductive powder.
Figure 5D:
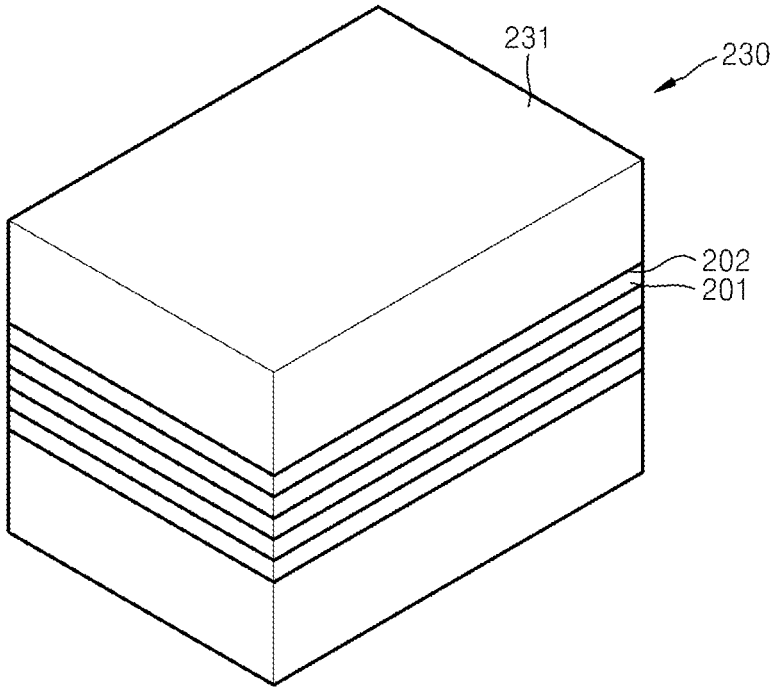
FIG. 5D is a diagram illustrating a sintered structure formed by sintering a molded structure including a plurality of graphene thin films stacked apart from each other in a conductor.

The graphene stack structure 210 is molded and sintered together with a conductive powder P. Referring to FIG. 5C, the conductive powder P is filled in a mold 220, and the graphene stack structure 210 is placed on the conductive powder P. In this case, the graphene stack structure 210 is inserted in the mold 220 in a horizontal state. The conductive powder P is filled on the graphene stack structure 210 again. Next, the graphene stack structure 210 is molded together with the conductive powder P by applying pressure thereto through a piston. Thus, a molded structure is formed. Alternatively, after cutting the graphene stack structure 210 to a required size, the cut graphene stack structure may be molded together with the conductive powder P. Next, the molded structure is taken out from the mold 220 and is sintered at a temperature of about 800° C. to about 1000° C. in vacuum or a reduced atmosphere. Thus, a sintered structure 230 in which the plurality of graphene thin films 202 are stacked apart from each other in a conductor 231 may be obtained as illustrated in FIG. 5D. In addition, a defect of graphene that may be caused when forming the plurality of graphene thin films 202 may be reduced through the sintering process. The conductive powder P may be a metal powder including a metal, such as copper, nickel, cobalt, iron, platinum, gold, aluminum, chromium, magnesium, manganese, molybdenum, rhodium, silicon, tantalum, titanium, tungsten, or the like. The conductive powder P may be a powder of the same metal as the conductive film 201 so that a fine sintering may be performed through the sintering process.

[Cutting]

Figure 5E:
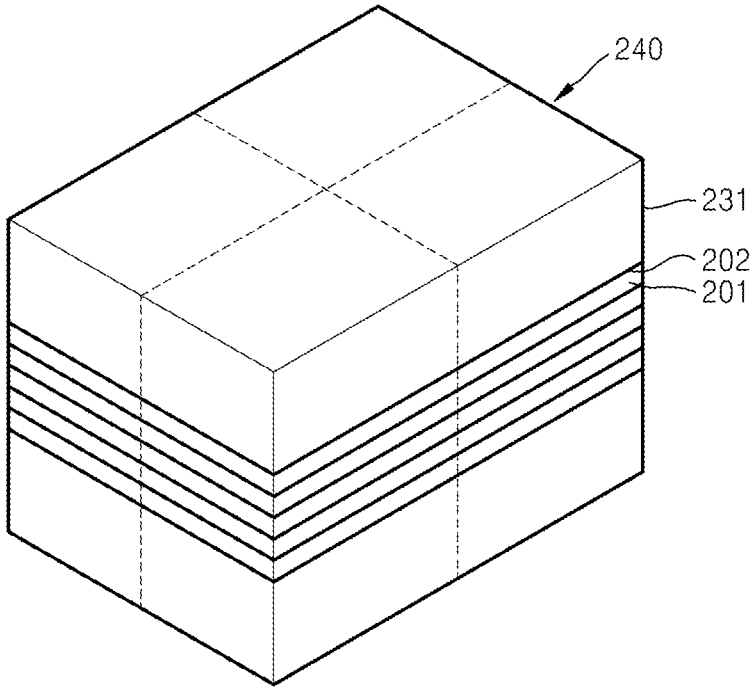
FIG. 5E is a diagram illustrating a cut structure formed by cutting a sintered structure to an appropriate size.

When necessary, as illustrated in FIG. 5E, a cut structure 240 may be formed by cutting the sintered structure 230 to an appropriate size.

[Formation of Emitter 30]

Figure 5F:
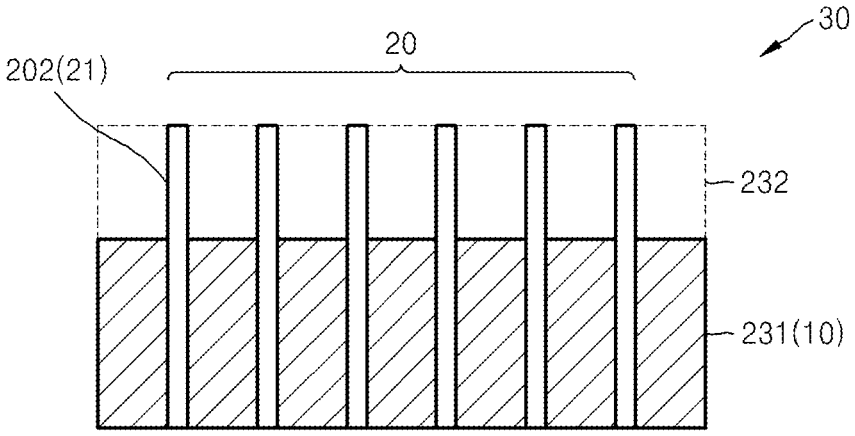
FIG. 5F is a diagram illustrating a form in which a portion of a conductor is removed from a sintered structure or a cut structure in length direction of the graphene thin films to expose the graphene thin films.

Next, as illustrated in FIG. 5F, a portion 232 of the conductor 231 is removed from the sintered structure 230 or the cut structure 240 in a length direction of the graphene thin films 202 to expose the graphene thin films 202. Thus, the graphene thin films 202 are exposed from the conductor 231 thereby forming a vertical structure. Removing the portion 232 of the conductor 231 may be performed by a surface etching process using an etchant that selectively corrodes the conductor 231. For example, sulfuric acid, hydrochloric acid, nitric acid, ammonium per-sulfate, copper ammonium chloride, or the like may be used as the etchant. Since graphene has a strong corrosion resistance with respect to most acid solution corroding metals, only the portion 232 of the conductor 231 may be removed by the surface etching process.

Figure 5G:
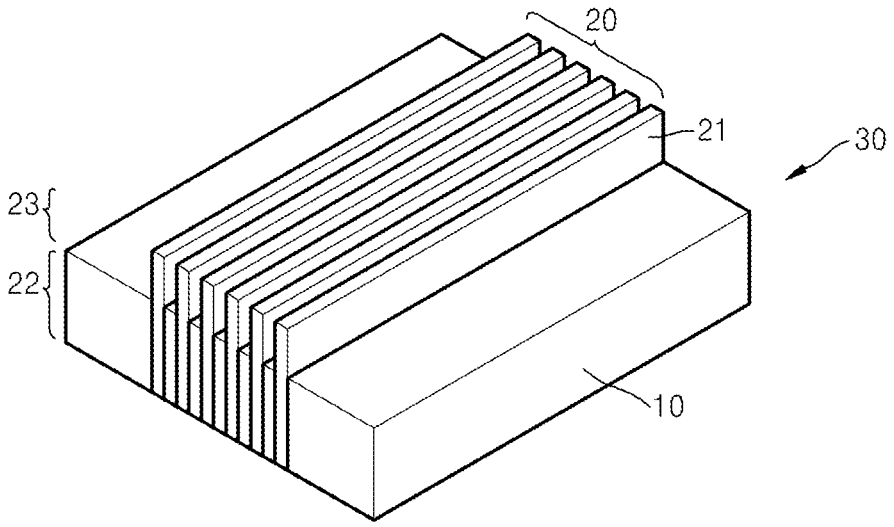
FIG. 5G is a perspective view of the emitter of FIG. 2, manufactured by processes illustrated in FIGS. 5A through 5F.

Through the processes described above, the emitter 30, which includes a cathode electrode 10 and an electron emission source 20 including the graphene thin films 21, may be formed as illustrated in FIGS. 5F and 5G. Each of the graphene thin films 21 has a vertical form, and includes a first portion 22 buried in the cathode electrode 10 and a second portion 23 that protrudes from the upper surface of the cathode electrode 10.

The pointed emitter 30*a* illustrated in FIG. 4 may be manufactured by using the following method.

[Formation of Spire-shaped Structure]

Figure 5H:
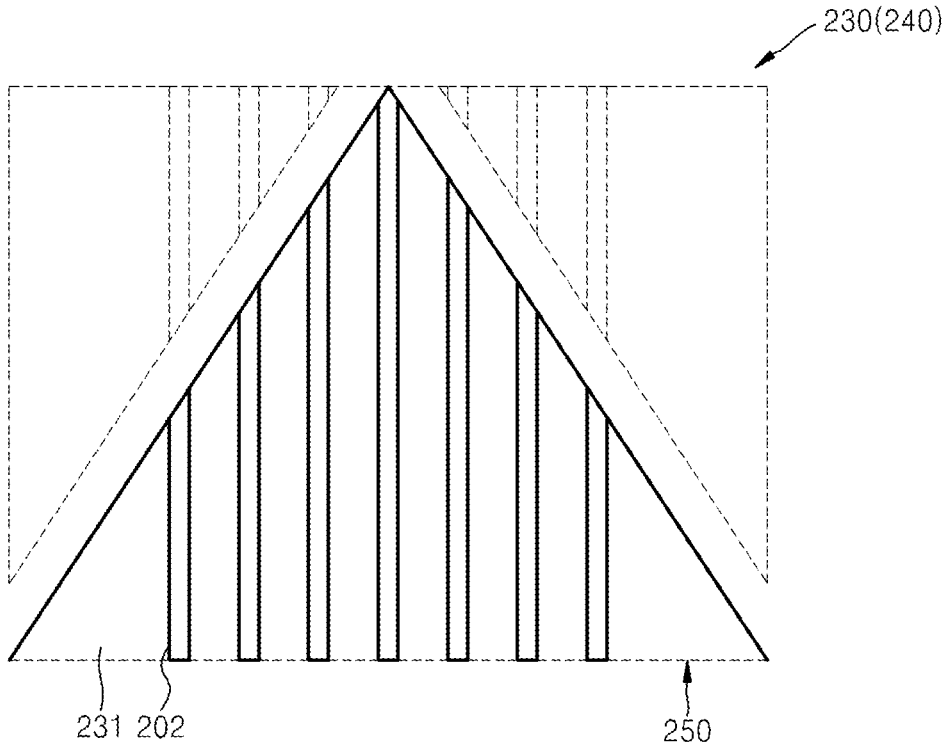
FIG. 5H is a diagram illustrating a form in which the sintered structure illustrated in FIG. 5D or the cut structure illustrated in FIG. 5E is slantingly cut with respect to the length direction of graphene thin films to form a spire-shaped structure.

First, the processes described with reference to FIGS. 5A through 5D (or 5E) are performed. Next, after vertically aligning the sintered structure 230 or the cut structure 240 in the length direction of the graphene thin films 202, the sintered structure 230 or the cut structure 240 is slantingly cut with respect to the length direction of the graphene thin films 202. Thus, as illustrated in FIG. 5H, a spire-shaped structure 250 in which the graphene thin films 202 are stacked apart from each other in a conductor 231 and of which one end in the length direction of the graphene thin films 202 has a pointed shape, is formed.

[Formation of emitter 30*a*]

Figure 5I:
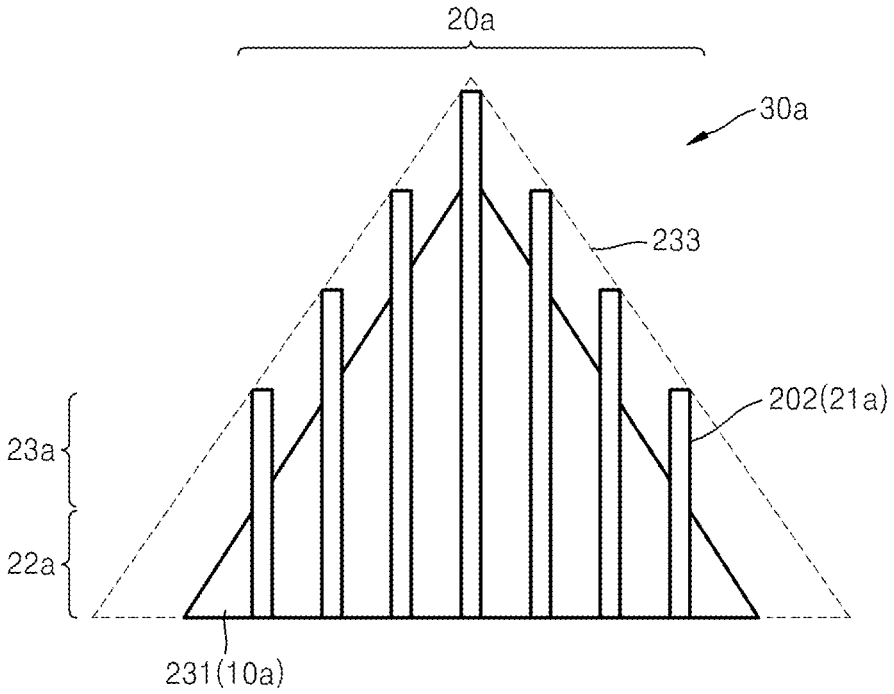
FIG. 5I is a diagram illustrating a form in which a portion of a conductor is removed from a spire-shaped structure in length direction of graphene thin films to expose the graphene thin films.

As illustrated in FIG. 5I, a portion 233 of the conductor 231 is removed from the spire-shaped structure 250 in the length direction of the graphene thin films 202 to expose the graphene thin films 202. Thus, the graphene thin films 202 are exposed from the conductor 231 and have a vertical form. The portion 233 of the conductor 231 may be removed by a surface etching process using an etchant that selectively corrodes the conductor 231. For example, sulfuric acid, hydrochloric acid, nitric acid, ammonium per-sulfate, copper ammonium chloride, or the like may be used as the etchant. Since graphene has a strong corrosion resistance with respect to most acid solution corroding metals, only the portion 233 of the conductor 231 may be removed by the surface etching process.

Figure 5J:
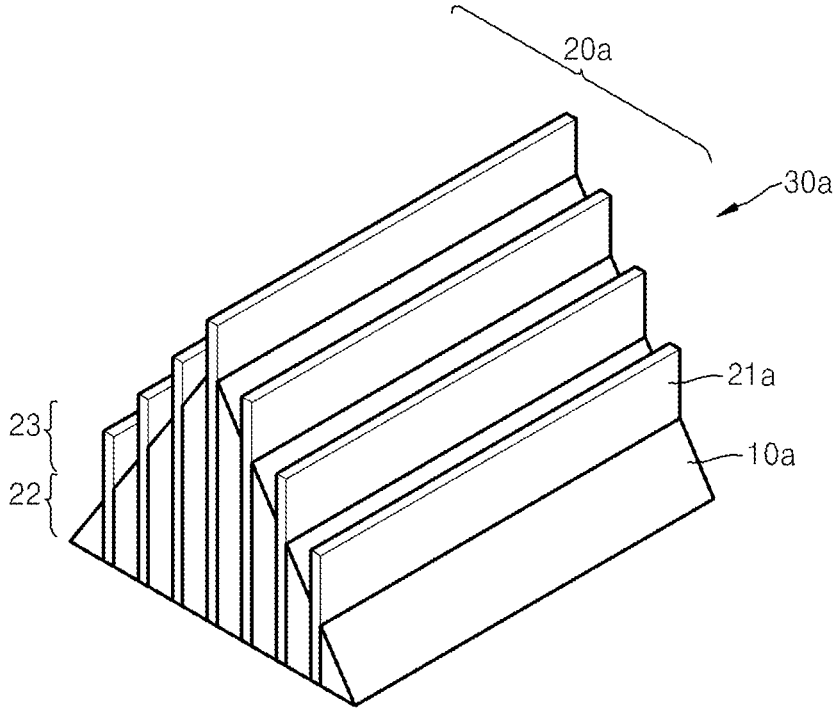
FIG. 5J is a perspective view of the emitter of FIG. 4, manufactured by processes illustrated in FIGS. 5A through 5E, 5G, and 5H.

Through the processes described above, the emitter 30*a*, which includes a cathode electrode 10*a* and an electron emission source 20*a* including graphene thin films 21 and has a pointed shape, may be formed as illustrated in FIGS. 5I and 5J. Each of the graphene thin films 21*a* has a vertical shape, and includes a first portion 22*a* buried in the cathode electrode 10*a* and a second portion 23*a* that protrudes from the upper surface of the cathode electrode 10*a*.

Figure 6:
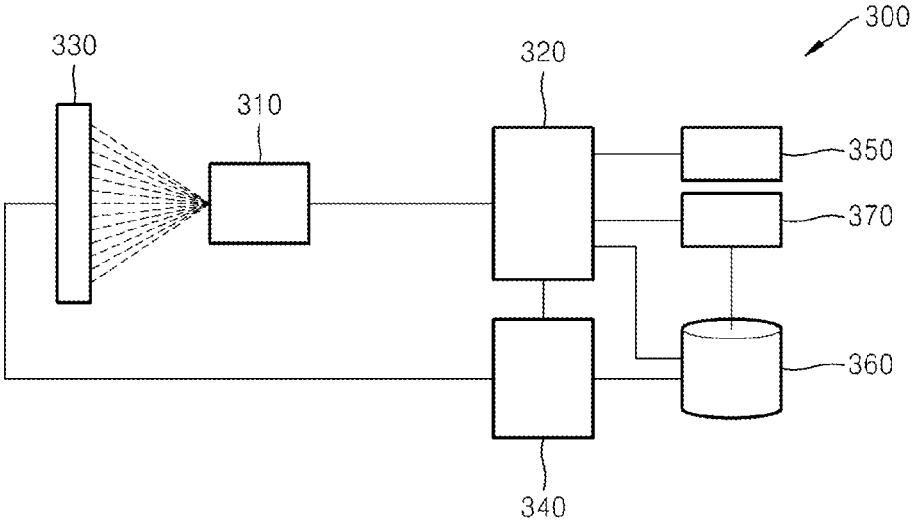
FIG. 6 is a schematic block diagram of an X-ray imaging device including the field emission device illustrated in FIG. 1.

The field emission device 1 described above may be used in various electronic apparatuses. FIG. 6 is a schematic block diagram of an X-ray imaging device 300 including the field emission device 1 illustrated in FIG. 1, according to some example embodiments of the inventive concept. Referring to FIG. 6, the X-ray imaging device 300 according to some example embodiments may include an X-ray emission device 310, a controller 320 for controlling the X-ray emission device 310, an imaging unit 330 for capturing an image from X-rays that pass through a target object after being emitted from the X-ray emission device 310, an image processor 340 for processing information about images captured by the imaging unit 330, an input unit 350 for inputting a user's input, an output unit 370 for outputting image-processed information, and a data storage unit 360 for storing various pieces of information including the information about images. As described above, when anode electrode formed of a metal, such as Mo, Ag, W, Cr, Fe, Co, Cu, or the like, or a metal alloy, is employed as the anode electrode 2 in FIG. 1, the X-ray emission device 310 for emitting X-rays may be implemented. Elements other than the X-ray emission device 310 are already known in the art, and thus, detailed descriptions thereof are omitted.

Figure 7:
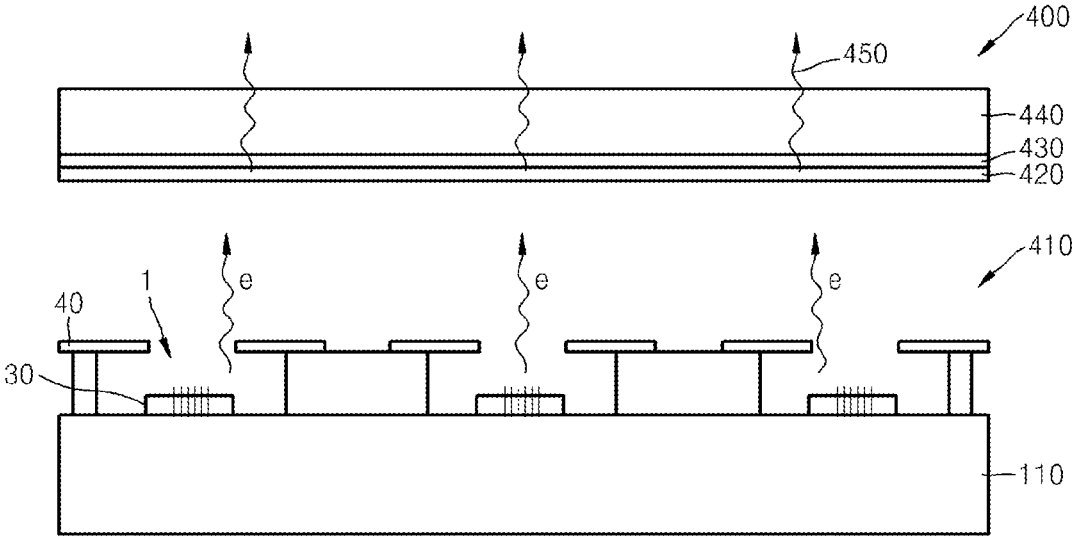
FIG. 7 is a diagram illustrating a back light device (display device) including the field emission device illustrated in FIG. 1.

FIG. 7 is a diagram illustrating a back light device (display device) 400 according to some example embodiments of the inventive concept. Referring to FIG. 7, an anode electrode layer 420, a fluorescent layer 430, and a transparent substrate 440 are disposed above an electron emission device 410 in which a plurality of field emission devices 1 as illustrated in FIG. 1 are arranged. Electrons "e" emitted from the electron emission device 410 pass through the anode electrode layer 420 and reach the fluorescent layer 430. The fluorescent layer 430 is formed of a cathode luminescence (CL)-typed fluorescent material that is excited by the electrons "e" and thus generates visible light 450. Thus, the electrons "e" are converted into visible light 450 when colliding with the fluorescent layer 430. The anode electrode layer 420 and the fluorescent layer 430 may be disposed in reverse order.

The back light device (display device) 400 may be used as a backlight unit (BLU) of a display device, such as a liquid crystal display (LCD), which is not capable of autonomously emitting light, or a backlight unit of a lighting apparatus. Also, the back light device (display device) 400 itself may be used as an image display device. For example, when all of the emitters 30 of the electron emission device 410 are driven, the back light device (display device) 400 may become a back light unit of a display device or a lighting apparatus. When the emitters 30 of the electron emission device 410 form a pixel array in which the emitters 30 are independently driven for each pixel, the back light device (display device) 400 itself may become a display device displaying an image.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A method of manufacturing an emitter, the method comprising:

forming a graphene thin film on a surface of a conductive film;

forming a stack structure in which the graphene thin film and the conductive film are repeatedly stacked;

forming a sintered structure by molding and sintering the stack structure and a conductive powder, wherein the sintered structure has a form in which the grapheme thin film is in a conductor; and partially removing the conductor in a length direction of the graphene thin film.

2. The method of claim 1, wherein the forming of the stack structure comprises folding the conductive film on which the graphene thin film is formed a number of times.

3. The method of claim 1, wherein a material of the conductive film is the same as that of the conductive powder.

4. The method of claim 1, further comprising:

slantingly cutting the sintered structure with respect to the length direction of the graphene thin film to form a spire-shaped structure before performing the partially removing of the conductor.

5. The method of claim 1, wherein the graphene thin film is a graphene single-layered film or a graphene multi-layered film.

* * * * *